United States Patent [19]

De Jong

[11] Patent Number: 4,797,595

[45] Date of Patent: Jan. 10, 1989

[54] ELECTRODELESS LOW-PRESSURE DISCHARGE LAMP HAVING A STRAIGHT EXHAUST TUBE FIXED ON A CONICAL STEM

[75] Inventor: Henricus J. J. M. De Jong, Terneuzen, Netherlands

[73] Assignee: U.S. Philips Corp., New York, N.Y.

[21] Appl. No.: 68,660

[22] Filed: Jun. 30, 1987

[30] Foreign Application Priority Data

Jun. 30, 1986 [NL] Netherlands ..... 8601702

[51] Int. Cl.[4] ..... H01J 65/04

[52] U.S. Cl. ..... 313/493; 313/490; 313/565; 313/634; 313/546; 445/38

[58] Field of Search ..... 315/248, 267; 313/546, 313/634, 317, 561, 550, 551, 490, 493, 564, 565; 445/38; 141/65, 59; 53/403, 405

[56] References Cited

U.S. PATENT DOCUMENTS

| | | | |
|---|---|---|---|
| 2,197,398 | 4/1940 | Smith | 315/248 |
| 3,983,439 | 9/1976 | Blommerde et al. | 313/546 |
| 4,437,041 | 3/1984 | Roberts | 313/490 |
| 4,499,400 | 2/1985 | Anderson et al. | 313/490 |
| 4,622,495 | 11/1986 | Smeelen | 313/550 |

OTHER PUBLICATIONS

"Neues aus der Technik", vol. No. 1, Feb. 1986, pp. 1–2.

*Primary Examiner*—David K. Moore
*Assistant Examiner*—Mark R. Powell
*Attorney, Agent, or Firm*—Brian J. Wieghaus

[57] ABSTRACT

Electrodeless low-pressure discharge lamp having a lamp vessel sealed in a gas-tight manner and filled with a metal vapor and a rare gas. The lamp vessel comprises a glass envelope which is connected in a gas-tight manner to the edge of a conically widening collar at the end of a tubular part of a sealing member also made of glass. The tubular part accommodates a rod-shaped core of a magnetic material by means of which a discharge is generated in the lamp vessel during operation of the lamp. An exhaust tube extends parallel to the longitudinal axis of the tubular part terminating at the wall of the conical collar. The end of the exhaust tube engages round an orifice in a planar surface in a cam-shaped recess provided in the wall of the conical collar. The planar surface extends substantially at right angles to the longitudinal axis of the tubular part of the sealing member.

6 Claims, 1 Drawing Sheet

ELECTRODELESS LOW-PRESSURE DISCHARGE LAMP HAVING A STRAIGHT EXHAUST TUBE FIXED ON A CONICAL STEM

BACKGROUND OF THE INVENTION

The invention relates to an electrodeless low-pressure discharge lamp having a lamp vessel which is sealed in a gas-tight manner and is filled with a metal vapor and a rare gas. The lamp vessel comprises a glass envelope which is connected in a gas-tight manner to the edge of a conically widening collar at the end of a tubular part of a sealing member also made of glass. The tubular part accommodates a rod-shaped core of a magnetic material by means of which a discharge is generated in the lamp vessel during operation of the lamp. The known lamp has an exhaust tube which extends parallel to the longitudinal axis of the tubular part of the sealing member and terminates at the wall of the conical collar. A lamp of this type is known from "Neues aus der Technik", 1986, 1.

The sealing member in the known lamp is in the form of a stem which is connected in a gas-tight manner by means of sealing glass to the envelope-shaped part of the lamp vessel. The use of a stem in itself is quite conventional in tubular low-pressure mercury discharge lamps provided with electrodes and in incandescent lamps. In these lamps the stems are provided with electrodes and a tubular exhaust tube which terminates in a so-called pinch which is located on or near the longitudinal axis of the stem. An exhaust tube is required for exhausting the lamp vessel, that is to say, filling the lamp vessel with a desired rare gas atmosphere, degassing of electrodes, the wall and other components of the lamp vessel, etc.

However, due to the presence of the rod-shaped magnetic core there is no space for an exhaust tube in the centrally located tubular part of the sealing member formed as a stem in an electrodeless lamp. However, these lamps also require exhausting of the lamp vessel.

In the known lamp the exhaust tube is therefore connected to the conical collar of the sealing member. For the purpose of satisfactory progress of exhausting in a bulk manufacturing process it is desirable that an exhaust tube extends in the direction of the longitudinal axis of the lamp vessel (the same direction as the longitudinal axis of the tubular part). When the end of an exhaust tube engages a wall which extends obliquely with respect to the said longitudinal axis, it is necessary that prior to or subsequent to fixation to the said wall part the exhaust tube is bent until the correct position (in the direction of the longitudinal axis) for exhausting is reached. This bending process is an additional time-consuming step in the manufacturing process creating a ready risk of breakage of the sealing member or the exhaust tube.

SUMMARY OF THE INVENTION

It is an object of the invention to provide an electrodeless low-pressure in a bulk manufacturing process in which the above-mentioned drawbacks of the known lamps are obviated.

According to the invention, an electrodelss low-pressure discharge lamp of the type described in the opening paragraph is therefore characterized in that the wall of the conical collar is provided with a cam-shaped recess having a bottom part which is a planar surface perpendicular to the longitudinal axis of the tubular part of the sealing member. The end of an exhaust tube is connected to the perpendicular surface and the exhaust tube is aligned with the longitudinal axis of the tubular part. An orifice in the perpendicular surface allows communication between the exhaust tube and the inner space of the lamp vessel.

The advantage of the lamp according to the invention is that the exhaust tube can be fixed in the correct position to the conical collar without extra operations during the manufacturing process. It has been found that the risk of breakage in the glass wall of the collar around the point of fixation of the exhaust tube is small during manufacture of the lamps.

In the manufacture of the lamp the cam-shaped recess is firstly provided in the conical wall part by locally heating the glass over a small surface area. The recess having the perpendicular planar surface is formed by means of an abutment. Subsequently the end of the exhaust tube is connected to the bottom part by softening the end of the exhaust tube and an opening is provided in the bottom part. The exhaust tube is then positioned in the vertical direction, that is to say, parallel to the longitudinal axis of the lamp. Subsequently the exhausting process can be carried out.

In a practical embodiment of the lamp according to the invention two parallel exhaust tubes located diametrically opposite each other are fixed to the conical collar. The exhausting process can then be carried out in an efficient manner by introducing a quantity of gas into the lamp vessel via a first exhaust tube and by removing unwanted gases via the second exhaust tube.

In a special embodiment one of the exhaust tubes is provided with an amalgam to control the mercury vapour pressure during operation of the lamp. In order to prevent the amalgam from reaching the lamp vessel, the opening in the bottom art of the recess associated with that exhaust tube is relatively small. Due to the substantially horizontally extending shape of the bottom art the size of the opening can be adjusted in a simple manner, for example, by punching a softened spot in the bottom part with a pin having a defined diameter.

The invention will be be described in greater detail with reference to the accompanying drawing.

DESCRIPTION OF THE PREFERRED EMBODIMENT

Figure 1:
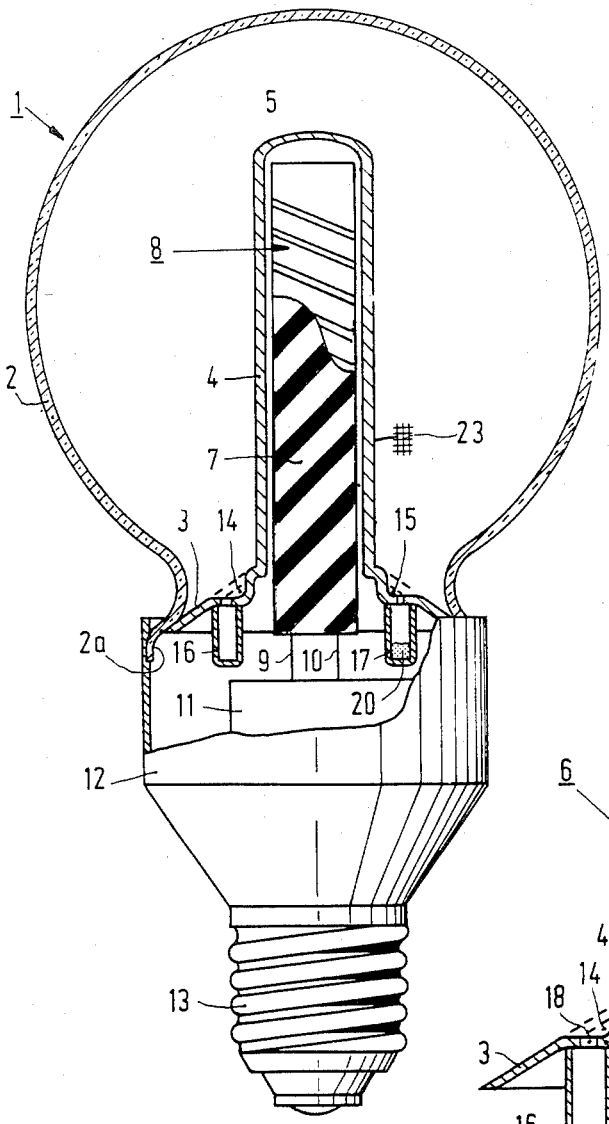
FIG. 1 shows an embodiment of an electrodeless low-pressure mercury vapour discharge lamp according to the invention and FIG. 2 shows the sealing member of the lamp vessel of the lamp of FIG. 1 in detail.
Figure 2:
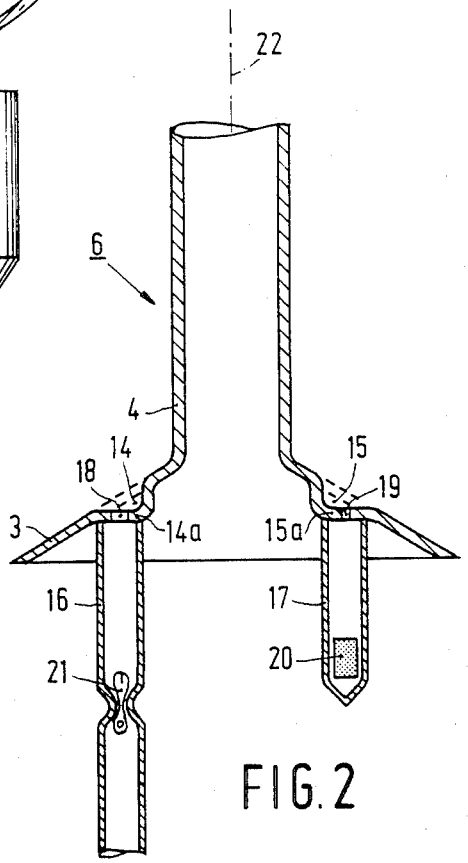

The lamp according to FIG. 1 comprises a glass lamp vessel 1 which is sealed in a gas-tight manner and is filled with mercury and a rare gas. The lamp vessel has a glass envelope 2 whose inner wall is provided with a luminescent coating (not shown) and whose lower side has a recess with a circular raised edge 2*a*. The edge of a conically widening collar 3 is secured at the area of the edge 2*a* in a gas-tight manner by means of sealing glass ("solder glass"), which collar is located at the end of a tubular part 4 which is sealed at its other end (the upper side)5. The tubular part 4 and the collar 3 form one integral assembly, sometimes referred to as the stem. This stem is actually the sealing member 6 (see FIG. 2) for the envelope-shaped part 2 of the lamp vessel. The tubular part 4 accommodates a rod-shaped core 7 of ferrite. A winding 8 having a number of copper wire turns is provided around this core 7. The supply wires 9 and 10 of the winding 8 are electrically connected to a high-frequency supply unit which is accommodated in the housing 11. During operation of the lamp an electric field is generated in the lamp vessel causing a discharge. The housing 11 is surrounded by a synthetic material wall part 12 which is secured to the lamp vessel 1 at one end and is provided with an Edison lamp cap 13 at its other end.

Cam-shaped recesses 14 and 15 by means of which two tubular exhaust tubes 16 and 17, respectively, are fixed to the collar wall 3 by means of a fusing process are provided in the wall of the conical collar 3 in two positions which are located diametrically opposite each other. To this end each cam-shaped recess is provided with a flat bottom part extending at right angles to the longitudinal axis 22 of the tubular part of the sealing member 6. This is shown in detail in FIG. 2. As is evident from FIG. 2, axis 22 is substantially the longitudinal axis of the lamp.

The bottom part of recess 14 is denoted by 14*a* (see FIG. 2) and that of recess 15 is denoted by 15*a*. The end of an exhaust tube is positioned against each bottom part. By means of an orifice in each bottom part the bores of the exhaust tubes are connected to the space within the lamp vessel.

In the embodiment shown the lamp vessel is exhausted via exhaust tube 16. (In the drawing this exhaust tube is shown with an open end). A relatively large orifice 18 in the bottom part 14*a* is present in the collar. The exhaust tube 17 is shown already sealed and provided with a vapour-pressure controlling amalgam 20 (In-Bi-Hg). To prevent this amalgam (which in solid form has the shape of a rod) from reaching the lamp vessel, the orifice 19 in bottom art 15*a* is much narrower than orifice 18 in the bottom part 14*a*. (The diameter orifice 19 is approximately 0.5 mm; the internal diameter of the exhaust tube is approximately 3.2 mm). Furthermore a metal plate-shaped mercury capsule 21 which is fixed in the exhaust tube in known manner (see GB-PS No. 1,475,458,) is present in the exhaust tube 16. After exhausing, this exhaust tube 16 is sealed and the mercury is released from capsule 21. Furthermore the lamp vessel contains an In-starting amalgam 23 (see FIG. 1) on a gauze-shaped holder.

The diameter of orifice 19 is preferably between 0.3 and 0.7 mm. For smaller diameters insufficient mercury vapour diffuses to the lamp vessel. If the diameter is too large, there is a risk that amalgam 20, which preferably is a pellet with a diameter of about 1 mm in a ductile state, could pass into the lamp vessel through opening 19 during operation of the lamp.

The lamp according to FIG. 1 has a luminous efficiency of approximately 1200 lumen at a power supply of 17 W. The luminescent coating consists of a mixture of green-luminescing terbium-activating cerium magnesium aluminate and red-luminescing yttrium oxide activated by trivalent europium. A transparent conducting layer (not shown) of fluorine-doped tin oxide was provided between this luminescent coating and the wall of the lamp vessel to reduce interference currents in the supply mains during operation of the lamp.

What is claimed is:

1. In an electrodeless low-pressure discharge lamp of the type having a discharge vessel defining a lamp axis comprising an outer envelope with an open end and a stem sealed in a gas tight manner to said outer envelope at said open end, said stem comprising a tubular section extending along said lamp axis within said outer envelope and a conical collar extending between the end of the tubular section near said open end and said open end, and means for generating a discharge within said discharge vessel during lamp operation, said means comprising a magnetic core accommodated within said tubular section, the improvement comprising:

said conical collar comprising a recess having a planar portion transverse to the lamp axis;

an exhaust tube parallel to said lamp axis having an end joined to said transverse portion; and an orifice in said transverse portion positioned within the inner periphery of the exhaust tube for allowing communication between the exhaust tube and the interior space of the discharge vessel.

2. An electrodeless low-pressure discharge lamp as claimed in claim 1, wherein said collar comprises two of said recesses, and two exhaust tubes located diametrically opposite each other are fixed to a respective transverse planar surface on said conical collar.

3. An electrodeless low-pressure discharge lamp as claimed in claim 2, wherein one of said exhaust tubes is provided with an amalgam to control the mercury vapour pressure during operation of the lamp.

4. An electrodeless low-pressure discharge lamp as claimed in claim 3, wherein the orifice in the planar surface on which the end of the exhaust tube provided with the amalgam terminates is circular and has a diameter of 0.3 to 0.7 mm.

5. A lamp as claimed in claim 3, wherein a metal plate-shaped capsule containing mercury is secured in the other of said exhaust tubes.

6. A method of joining an exhaust tube to a glass surface slanted with respect to the longitudinal axis of a lamp, comprising:

(a) softening a portion of said slanted surface by heating;

(b) forming a planar surface in said softened portion transverse to the longitudinal lamp axis;

(c) fusing the end of an exhaust tube to said transverse planar surface with the exhaust tube parallel to the lamp longitudinal axis; and (d) forming an orifice in said perpendicular planar surface positioned within the base of the exhaust tube.

* * * * *

UNITED STATES PATENT AND TRADEMARK OFFICE

CERTIFICATE OF CORRECTION

PATENT NO. : 4,797,595

DATED : JANUARY 10, 1989

INVENTOR(S) : HENRICUS J.J.M. DE JONG

It is certified that error appears in the above-identified patent and that said Letters Patent is hereby corrected as shown below:

On the title page,

Item [21] change the Serial No. from "07/068,660" to --07/068,600--

Signed and Sealed this

Second Day of July, 199

*Attest:*

*Attesting Officer*

HARRY F. MANBECK, JR.

*Commissioner of Patents and Trademarks*